US009501031B2

(12) United States Patent
Hayashi et al.

(10) Patent No.: US 9,501,031 B2
(45) Date of Patent: Nov. 22, 2016

(54) PACKAGED CARTRIDGE, PACKING MATERIAL AND CARTRIDGE

(71) Applicant: CANON KABUSHIKI KAISHA, Tokyo (JP)

(72) Inventors: Naoki Hayashi, Kawasaki (JP); Isao Koishi, Yokohama (JP); Tetsushi Uneme, Kawasaki (JP); Masanari Morioka, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/013,668

(22) Filed: Aug. 29, 2013

(65) Prior Publication Data

US 2014/0064784 A1 Mar. 6, 2014

(30) Foreign Application Priority Data

Aug. 31, 2012 (JP) ..... 2012-191428

(51) Int. Cl.
*G03G 21/18* (2006.01)

(52) U.S. Cl.
CPC .... *G03G 21/181* (2013.01); *G03G 2215/0875* (2013.01); *G03G 2221/1684* (2013.01)

(58) Field of Classification Search
CPC ..... G03G 21/181; G03G 2215/0875; G03G 2221/1684
USPC ..... 399/111, 110, 107
See application file for complete search history.

(56) References Cited

U.S. PATENT DOCUMENTS 5,871,097 A * 2/1999 Shida et al. ..... 206/521
6,321,911 B1 11/2001 Raimer et al.
6,704,522 B2 3/2004 Sasago et al.
6,714,746 B2 3/2004 Morioka et al.
6,898,399 B2 5/2005 Morioka et al.
6,937,832 B2 8/2005 Sato et al.

(Continued)

FOREIGN PATENT DOCUMENTS

CN 1069595 C 2/1998
CN 104334469 A 2/2015

(Continued)

OTHER PUBLICATIONS

Office Action in Chinese Patent Application No. 201310386051.8, dated Sep. 2, 2015 (with English translation).

(Continued)

*Primary Examiner* — Sophia S Chen
(74) *Attorney, Agent, or Firm* — Fitzpatrick, Cella, Harper & Scinto

(57) ABSTRACT

A packaged cartridge detachably mountable to an image forming apparatus includes: (i) a cartridge provided with a grip portion; (ii) a frame portion accommodating the cartridge, the frame portion including an opening and a recessed portion so that the grip portion is exposed through the opening so as to be capable of being gripped; and (iii) a cap portion movable, in a state in which the cartridge is accommodated in the recessed portion, relative to the frame portion between an open position where the opening is open and a closed position where the opening is closed. A gap is provided between the cartridge and an inner surface of the frame portion that when the frame portion is moved relative to the cap portion in an opening direction with a cap portion side of the packaged cartridge faced down, the cartridge interferes with the inner surface of the frame portion.

11 Claims, 16 Drawing Sheets

(56) References Cited

U.S. PATENT DOCUMENTS

| | | | |
|---|---|---|---|
| 6,963,706 | B2 | 11/2005 | Morioka et al. |
| 7,003,247 | B2 | 2/2006 | Koishi et al. |
| 7,072,601 | B2 | 7/2006 | Kakitani et al. |
| 7,079,787 | B2 | 7/2006 | Ogino et al. |
| 7,127,192 | B2 | 10/2006 | Batori et al. |
| 7,128,211 | B2 | 10/2006 | Nishi et al. |
| 7,139,502 | B2 | 11/2006 | Koishi et al. |
| 7,158,749 | B2 | 1/2007 | Ueno et al. |
| 7,184,690 | B2 | 2/2007 | Ueno et al. |
| 7,200,349 | B2 | 4/2007 | Sato et al. |
| 7,311,204 | B2 | 12/2007 | Nishi et al. |
| 7,315,710 | B2 | 1/2008 | Ueno et al. |
| 7,418,225 | B2 | 8/2008 | Morioka et al. |
| 7,457,566 | B2 | 11/2008 | Koishi et al. |
| 7,464,520 | B2 | 12/2008 | Nishi et al. |
| 7,681,379 | B2 | 3/2010 | Nishi et al. |
| 7,813,671 | B2 | 10/2010 | Nittani et al. |
| 7,856,192 | B2 | 12/2010 | Koishi et al. |
| 7,890,012 | B2 | 2/2011 | Koishi et al. |
| 7,992,715 | B2 | 8/2011 | Kwon |
| 8,135,304 | B2 | 3/2012 | Abe et al. |
| 8,139,979 | B2 | 3/2012 | Koishi et al. |
| 8,270,876 | B2 | 9/2012 | Morioka et al. |
| 8,275,283 | B2 | 9/2012 | Uneme et al. |
| 8,275,286 | B2 | 9/2012 | Ueno et al. |
| 8,280,278 | B2 | 10/2012 | Ueno et al. |
| 8,295,734 | B2 | 10/2012 | Ueno et al. |
| 8,401,441 | B2 | 3/2013 | Uneme et al. |
| 8,422,914 | B2 | 4/2013 | Hayashi et al. |
| 8,437,669 | B2 | 5/2013 | Morioka et al. |
| 8,452,210 | B2 | 5/2013 | Ueno et al. |
| 8,472,840 | B2 | 6/2013 | Abe et al. |
| 8,483,589 | B2 | 7/2013 | Uneme et al. |
| 8,526,841 | B2 | 9/2013 | Koishi et al. |
| 8,532,533 | B2 | 9/2013 | Ueno et al. |
| 2013/0064569 | A1 | 3/2013 | Ueno et al. |
| 2013/0164022 | A1 | 6/2013 | Uneme |
| 2013/0164028 | A1 | 6/2013 | Morioka et al. |
| 2013/0209137 | A1 | 8/2013 | Hayashi et al. |
| 2013/0216275 | A1 | 8/2013 | Morioka et al. |
| 2013/0287437 | A1 | 10/2013 | Miyabe et al. |
| 2013/0336674 | A1 | 12/2013 | Abe et al. |
| 2015/0114870 | A1 | 4/2015 | Fujino et al. |

FOREIGN PATENT DOCUMENTS

| | | | | |
|---|---|---|---|---|
| JP | 4-114173 | | 4/1992 | |
| JP | 07334066 | | 12/1995 | |
| JP | H10-29616 | A | 2/1998 | |
| JP | 11-268755 | * | 10/1999 | ..... B65D 43/22 |
| JP | 2001-199477 | * | 7/2001 | ..... B65D 81/113 |
| JP | 2001199477 | | 7/2001 | |
| JP | 2004-205793 | * | 7/2004 | ..... G03G 21/18 |
| JP | 3639834 | | 12/2004 | |
| JP | 2006137435 | | 6/2006 | |
| JP | 2008-298972 | * | 12/2008 | ..... G03G 21/18 |
| JP | 2012-150302 | A | 8/2012 | |
| JP | WO2013-183793 | A1 * | 12/2013 | ..... B65D 81/02 |

OTHER PUBLICATIONS

Office Action in Korean Patent Application No. 10-2013-0103779, dated Oct. 21, 2015.

Office Action in Taiwanese Patent Application No. 102129659, dated Nov. 5, 2015 (with English translation).

Notice of Allowance in Korean Patent Application No. 10-2013-0103779, mailed Jun. 16, 2016.

Notice of Allowance in Korean Patent Application No. 10-2013-0064789, mailed Jun. 16, 2016.

* cited by examiner

PACKAGED CARTRIDGE, PACKING MATERIAL AND CARTRIDGE

FIELD OF THE INVENTION AND RELATED ART

The present invention relates to a packaged cartridge and a packing material for packing a cartridge detachably mountable to an image forming apparatus, and relates to the cartridge packed in the packing material.

Examples of the image forming apparatus may include an electrophotographic copying machine, an electrophotographic printer (e.g., a laser beam printer, an LED printer or the like), a facsimile machine, and the like. Further, the cartridge includes, e.g., an electrophotographic photosensitive member as an image bearing member, or is a cartridge prepared by integrally assembling the electrophotographic photosensitive member with a developing means acting on the electrophotographic photosensitive member into a unit, which is detachably mountable to the image forming apparatus.

Further, the packing material is used for protecting the cartridge from external vibration and impact when the cartridge is transported.

An electrophotographic image forming apparatus, such as a printer, using an electrophotographic process electrically charges uniformly the electrophotographic photosensitive member as the image bearing member and then forms a latent image by selective exposure of the electrophotographic photosensitive member to light. Then, the latent image is developed with the developer to be visualized as a developer image. The developer image is then transferred onto a recording material (medium).

By applying heat and pressure to the transferred developer image, the developer image is fixed on the recording material, so that an image is recorded.

Such a conventional electrophotographic image forming apparatus was accompanied with supply of the developer and maintenance of various process devices.

As a means for facilitating such a developer supplying operation and maintenance, all or a part of the electrophotographic photosensitive image, a charging means, the developing means, a cleaning means and the like are integrally assembled, as a process cartridge, in a frame. A process cartridge type in which the process cartridge is detachably mountable to the electrophotographic image forming apparatus is employed.

According to the process cartridge type, the maintenance of the process cartridge can be performed in the form of replacement by a user himself (herself), and therefore it was possible to remarkably improve productivity. With respect to such a detachably mountable cartridge, the user replaces the cartridge. In this case, in general, the cartridge is taken out from an electrophotographic image forming apparatus main assembly and then is replaced with a new cartridge.

Here, the fresh cartridge shipped from a manufacturing factory is packed in the packing material for protecting the cartridge from vibration and impact during transportation. Further, at the time when the new cartridge is mounted in the apparatus main assembly, the packing material is unpacked and then a grip portion of the cartridge is gripped to take out the cartridge from the packing material. Then, the cartridge is mounted in the apparatus main assembly.

As the packing material for packing the cartridge and for protecting the cartridge from the vibration and impact during transportation, various packing material as described in Japanese Patent No. 3639834 and Japanese Laid-Open Patent Application (JP-A) Hei 4-114173.

Of these packing materials, according to a constitution in JP-A Hei 4-114173, the packing material is a member prepared by extrusion (molding) along an outer configuration of the cartridge. The packing material is provided with many projections and recesses, by which the cartridge is supported. Further, openings at end portions of the packing member are covered with a cap (cover) molded correspondingly to the outer configuration of the cartridge.

However, constitutions of Japanese Patent No. 3639834 and JP-A Hei 4-114173 involve the following problem.

In order to mount the cartridge into the apparatus main assembly, there was a need to take out, from a corrugated box, the cartridge contained in a bag and then to remove the bag and a casing formed of expanded polystyrene. That is, in order for the user to take out the cartridge from the packing material complicated steps are required for the user to be performed.

SUMMARY OF THE INVENTION

A principal object of the present invention is to provide a packing material capable of protecting a cartridge from vibration and impact during transportation and for permitting demounting of a cartridge from the packing material.

Another object of the present invention is to provide the cartridge.

According to an aspect of the present invention, there is provided a packaged cartridge detachably mountable to an image forming apparatus, comprising: (i) a cartridge provided with a grip portion; (ii) a frame portion accommodating the cartridge, the frame portion including an opening and a recessed portion so that the grip portion is exposed through the opening so as to be capable of being gripped; and (iii) a cap portion movable, in a state in which the cartridge is accommodated in the recessed portion, relative to the frame portion between an open position where the opening is open and a closed position where the opening is closed, wherein a gap is provided between the cartridge and an inner surface of the frame portion such that when the frame portion is moved relative to the cap portion in an opening direction with a cap portion side of the packaged cartridge faced down, the cartridge interferes with the inner surface of the frame portion.

According to another aspect of the present invention, there is provided a packing material for packing a cartridge detachably mountable to an image forming apparatus, comprising: (i) a frame portion including an opening, a recessed portion for accommodating the cartridge so that a grip portion provided on the cartridge is exposed through the opening so as to be capable of being gripped, and an engaging portion for engaging with the cartridge accommodated in the recessed portion and for limiting spacing of the cartridge from the recessed portion; and (ii) a cap portion movable, in a state in which the cartridge is accommodated in the recessed portion, relative to the frame portion between an open position where the opening is open and a closed position where the opening is closed.

According to a further aspect of the present invention, there is provided a cartridge detachably mountable to an image forming apparatus and capable of being packed by a packing material, comprising: (i) a frame portion including an opening, a recessed portion for accommodating the cartridge so that a grip portion provided on the cartridge is exposed through the opening so as to be capable of being gripped, and an engaging portion for engaging with the cartridge accommodated in the recessed portion and for limiting spacing of the cartridge from the recessed portion; and (ii) a cap portion movable, in a state in which the cartridge is accommodated in the recessed portion, relative to the frame portion between an open position where the opening is open and a closed position where the opening is closed, wherein the cartridge comprises: a grip portion for gripping the cartridge exposed through the opening so as to be capable of being gripped when the cap portion is located in the open position; and a portion-to-be-engaged to be engaged with the engaging portion to limit the spacing of the cartridge from the recessed portion when the cartridge is accommodated in the recessed portion.

These and other objects, features and advantages of the present invention will become more apparent upon a consideration of the following description of the preferred embodiments of the present invention taken in conjunction with the accompanying drawings.

Figure 8:
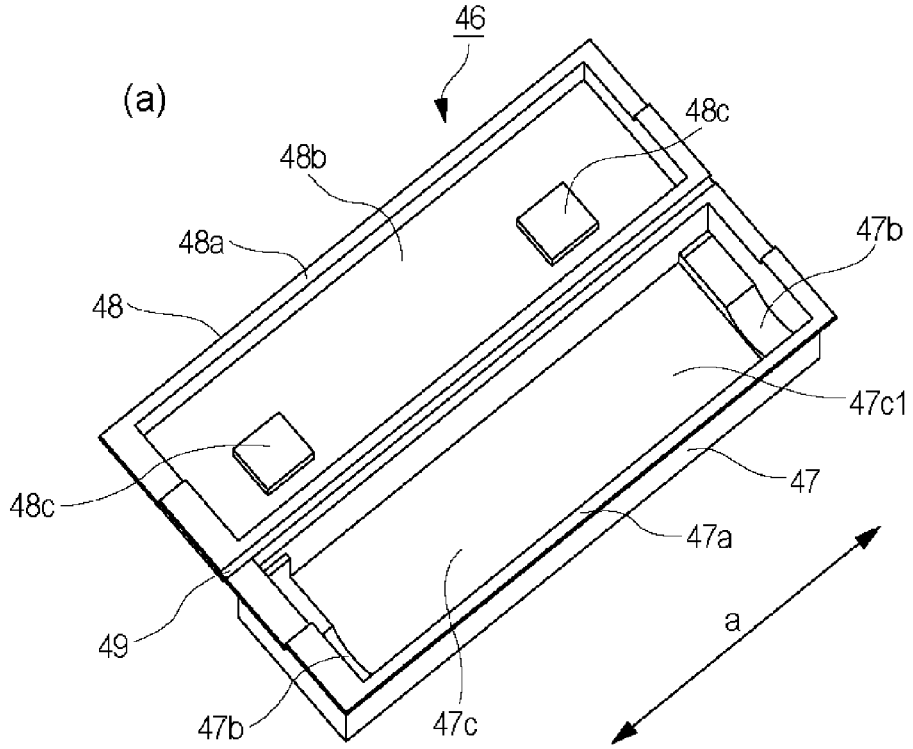
Figure 8:
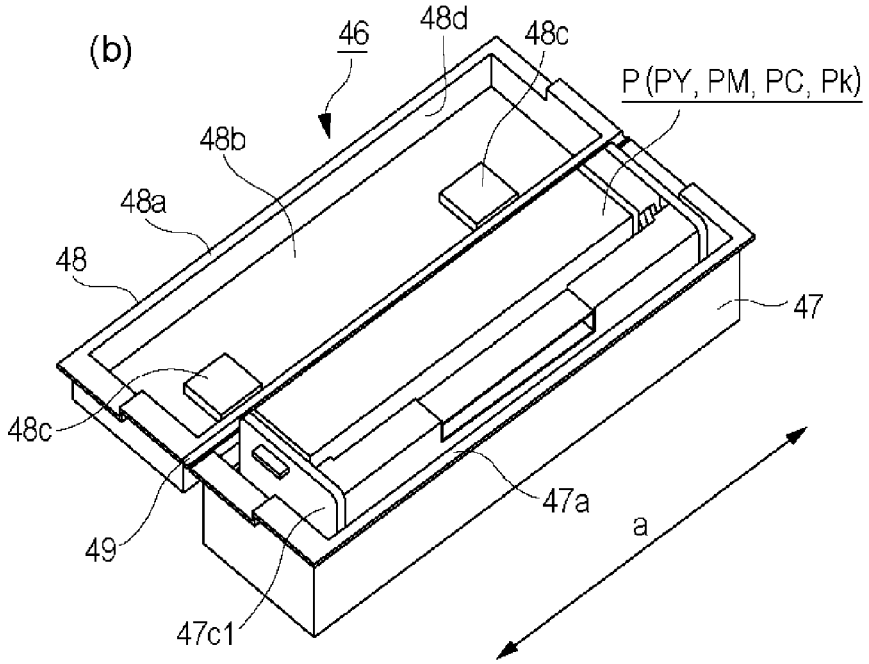

Parts (a) and (b) of FIG. 8 are schematic perspective views each showing the packing material in Embodiment 1, in which (a) shows a state in which the cartridge is demounted and (b) shows a state in which the cartridge is mounted.

Figure 9:
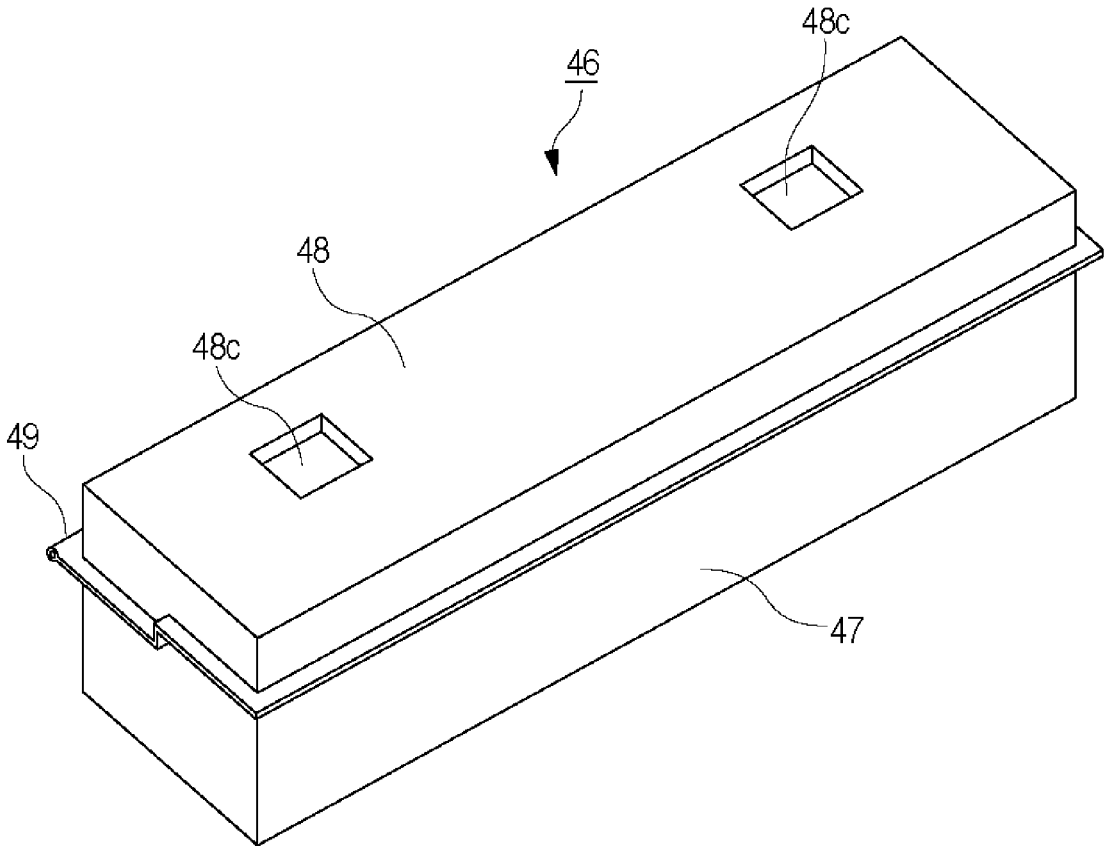

FIG. 9 is a schematic perspective view showing a cartridge packing state of the packing material in Embodiment 1.

Figure 10:
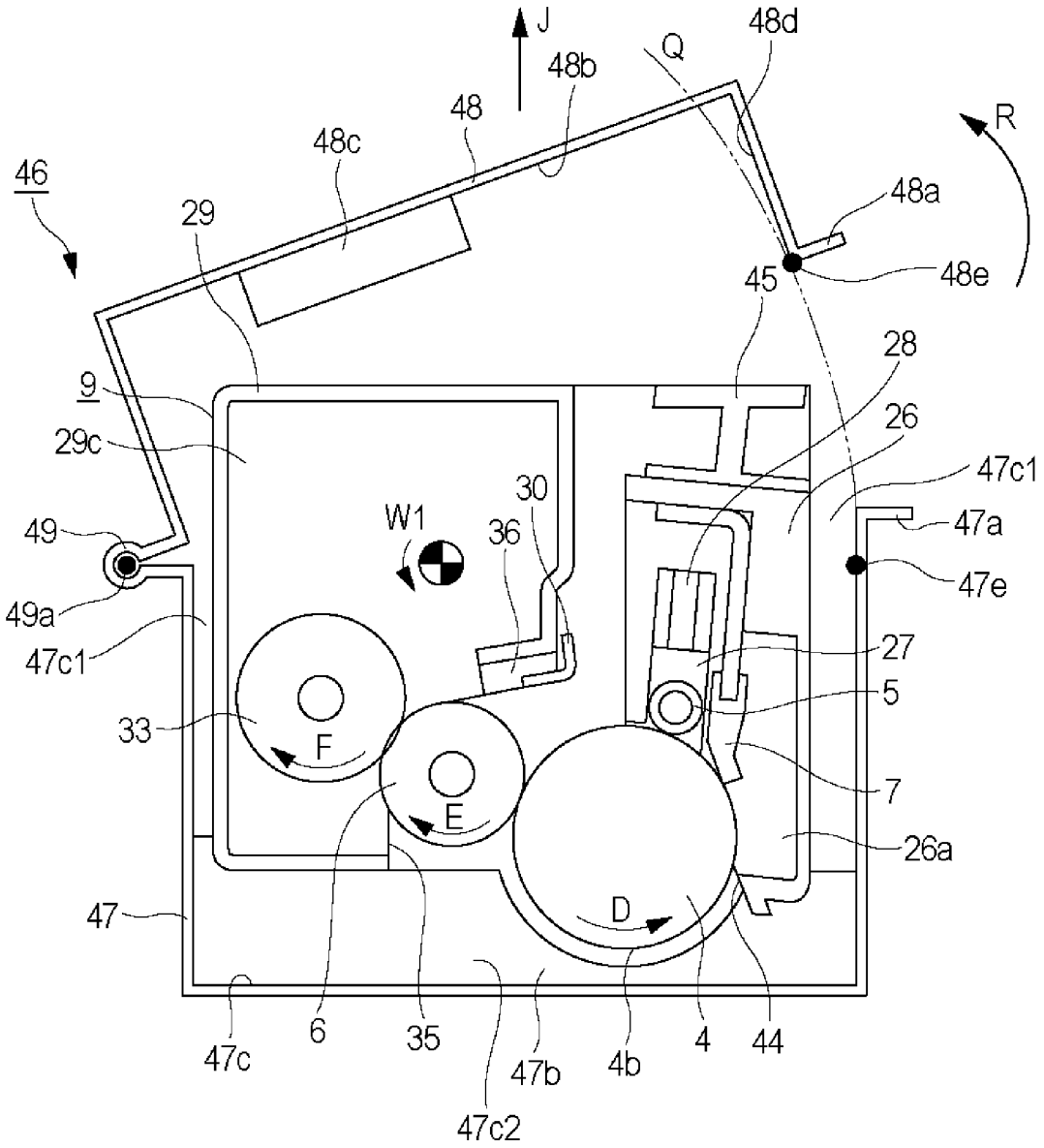

FIG. 10 is a schematic sectional view showing a process of demounting the cartridge from a cap portion side of the packing material in Embodiment 1.

Figure 11:
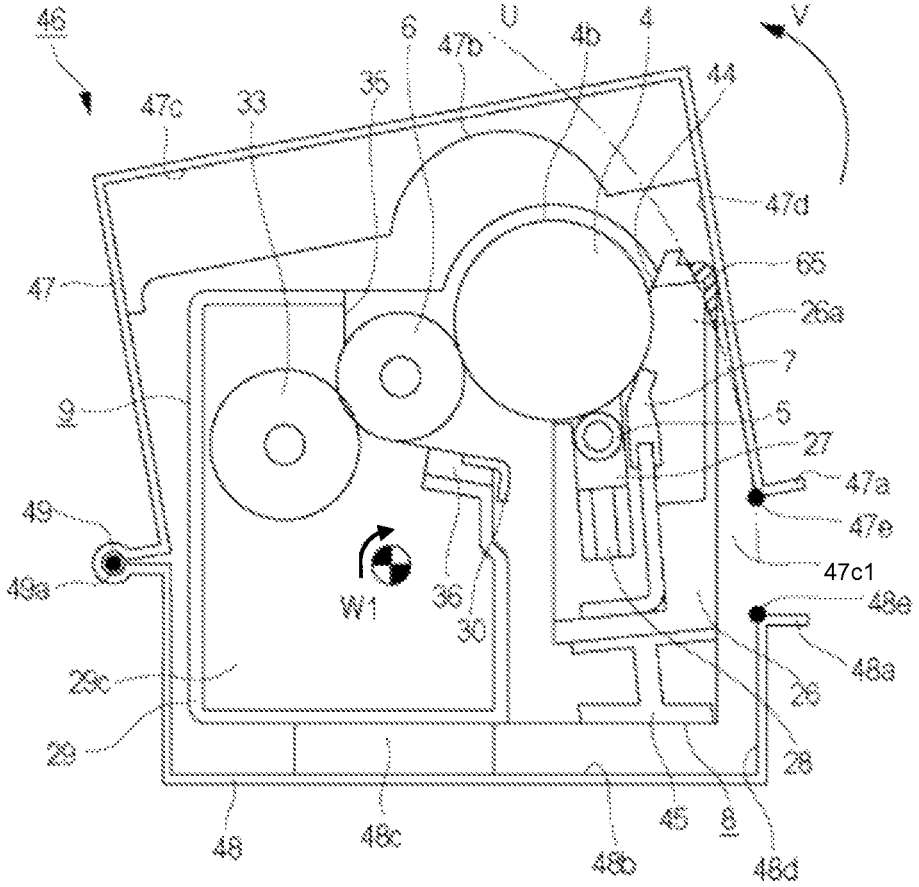

FIG. 11 is a schematic sectional view showing a process of demounting the cartridge from a frame portion side of the packing material in Embodiment 1.

Figure 12:
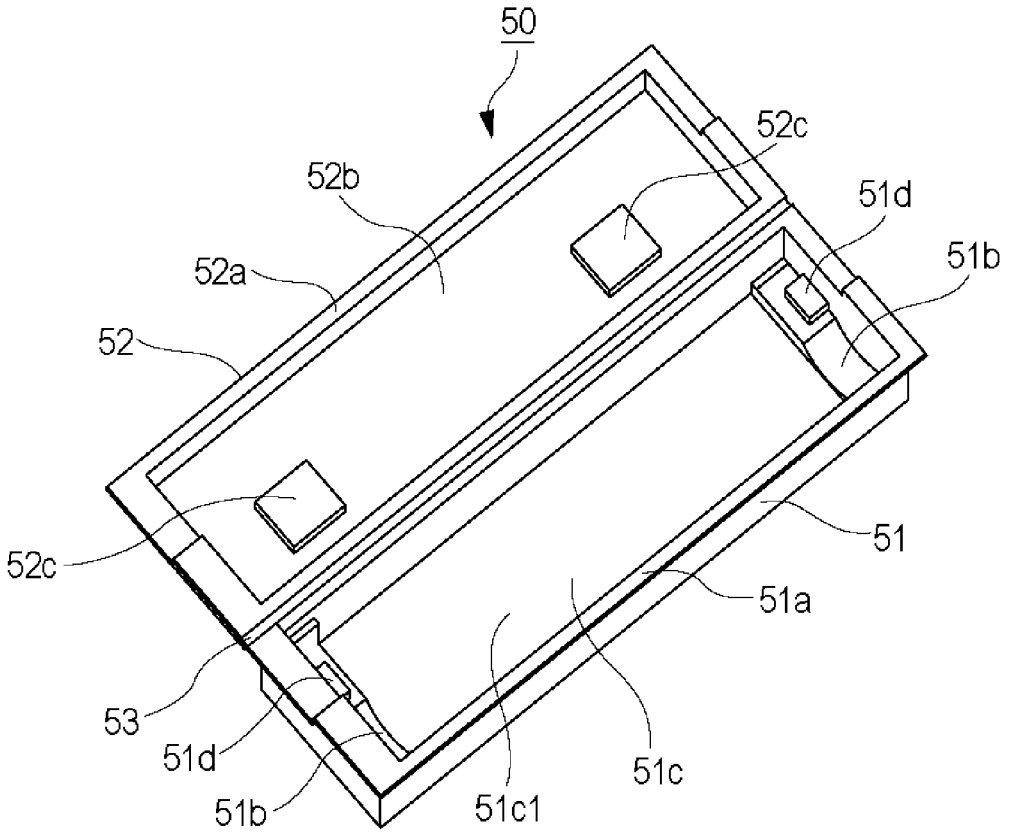

FIG. 12 is a schematic perspective view showing a state in which a cartridge is demounted from a packing material in Embodiment 2.

Figure 13:
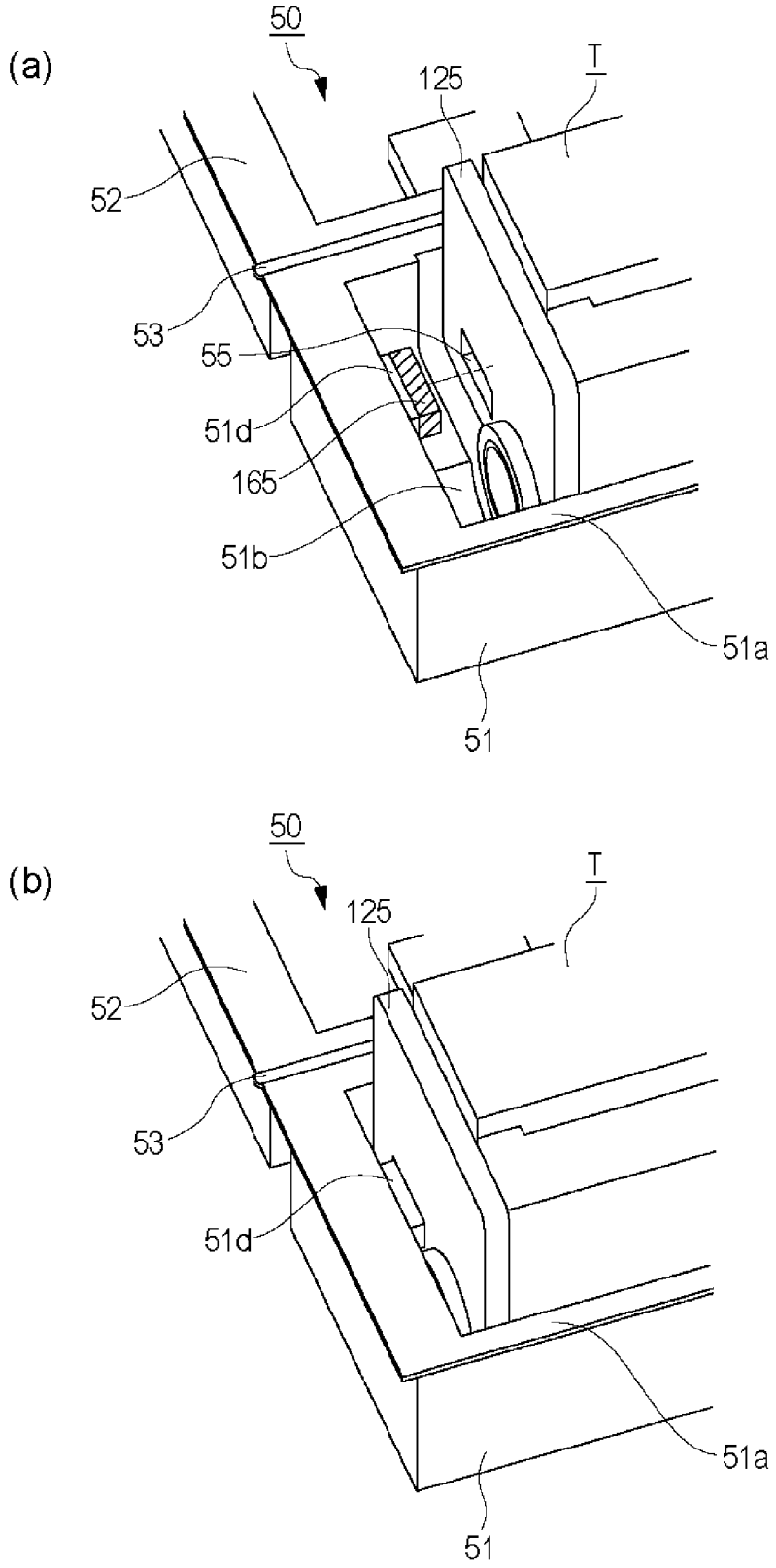

Parts (a) and (b) of FIG. 13 are schematic perspective views each showing an engaging state between the cartridge and the packing material in Embodiment 2.

Figure 14:
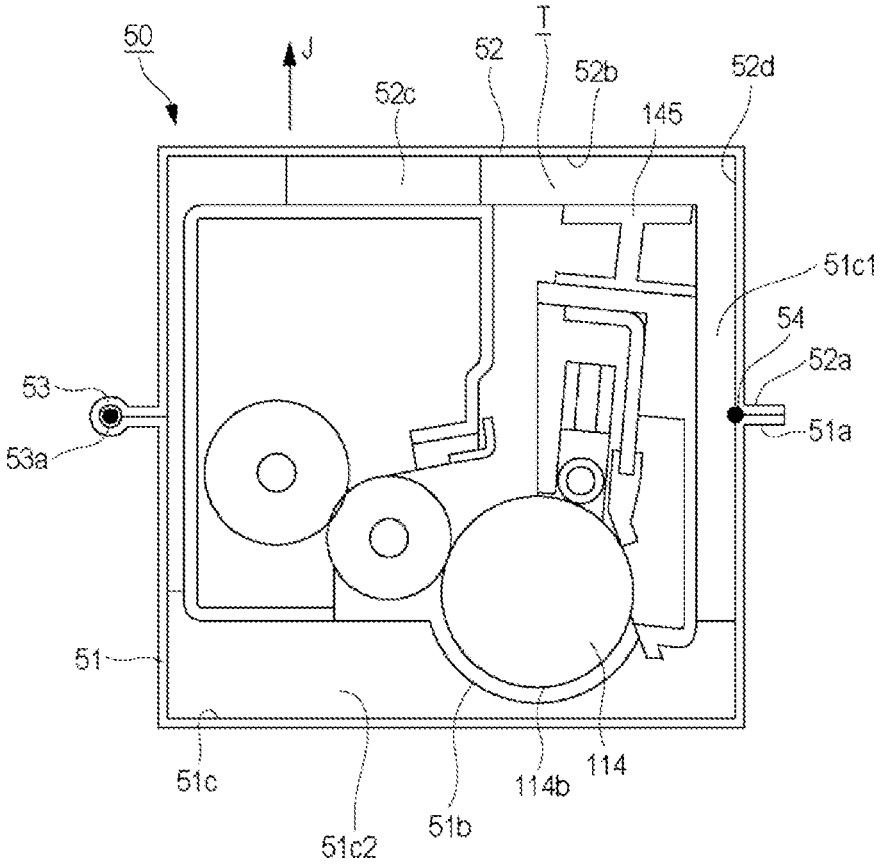

FIG. 14 is a schematic perspective view showing a packing state of the cartridge in the packing material in Embodiment 2.

Figure 15:
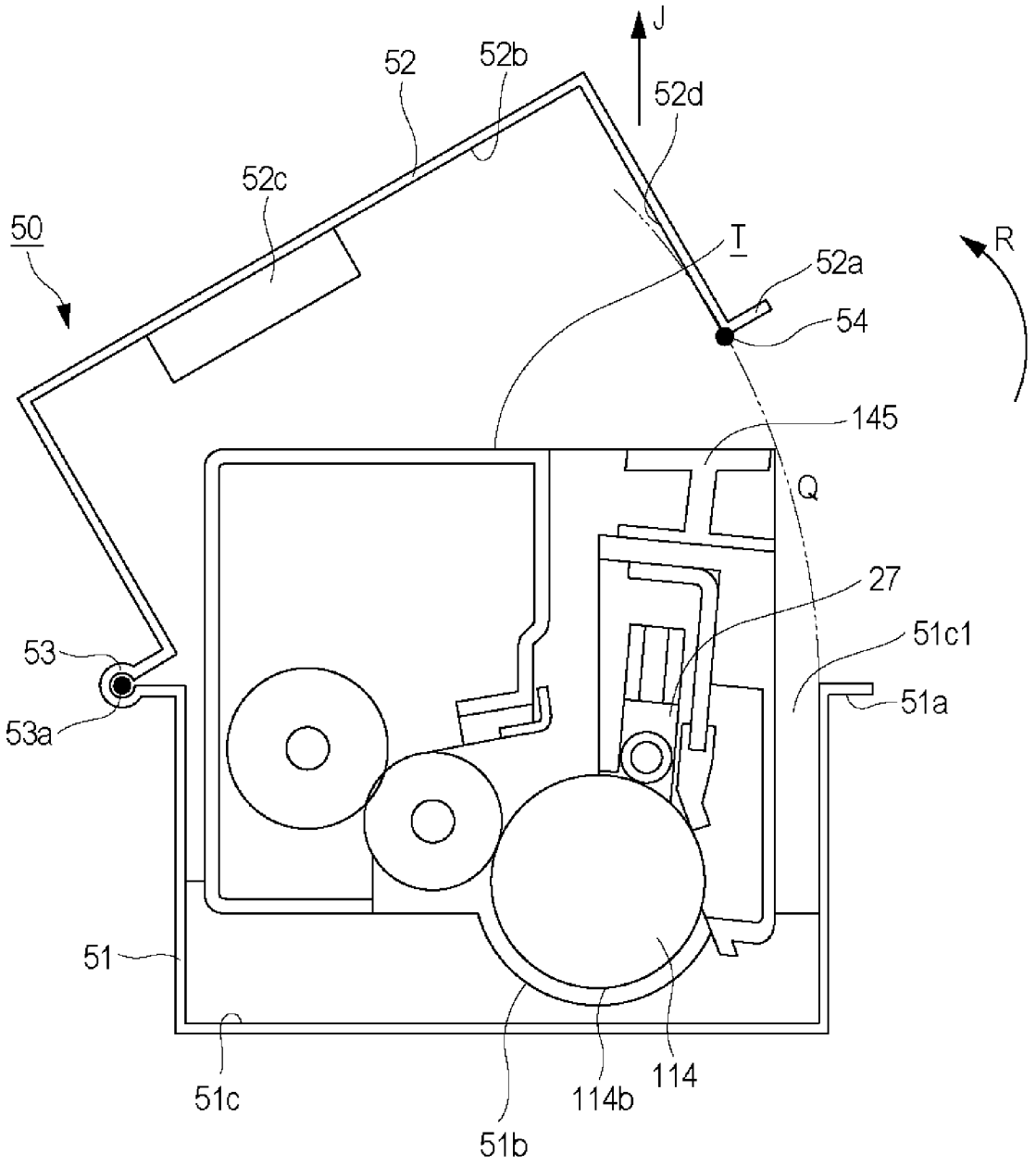

FIG. 15 is a schematic sectional view for illustrating a process of demounting the cartridge from a cap portion side of the packing material in Embodiment 2.

Figure 16:
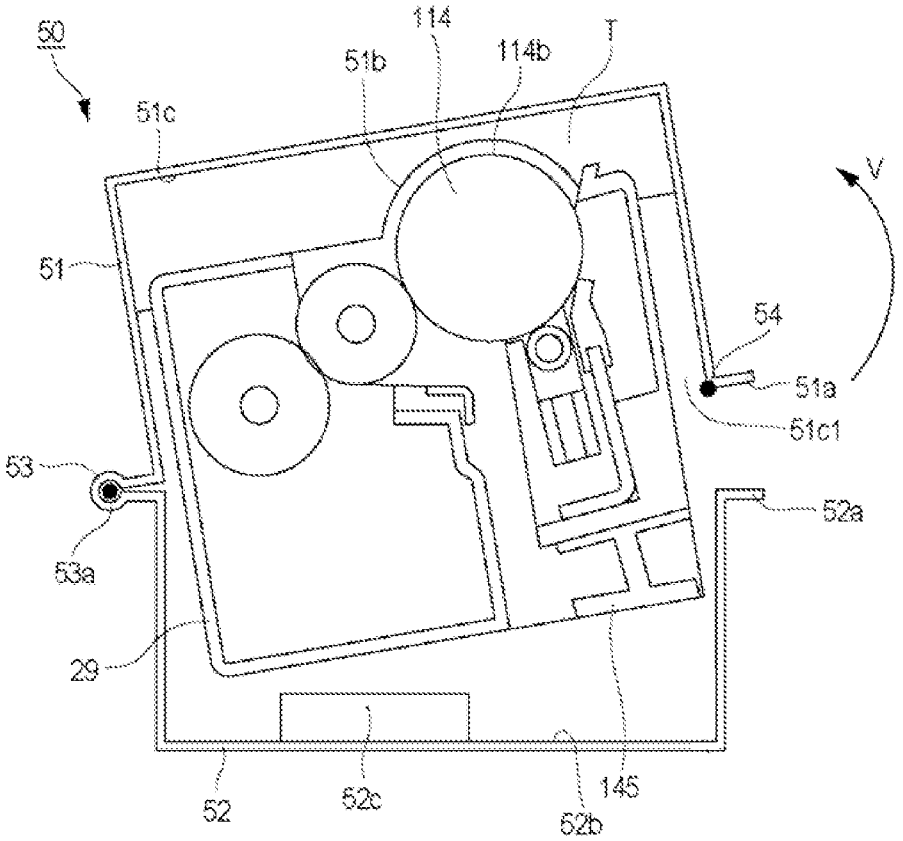

FIG. 16 is a schematic sectional view for illustrating a process of demounting the cartridge from a frame portion side of the packing material in Embodiment 2.

DESCRIPTION OF THE PREFERRED EMBODIMENTS (Embodiment 1)

Embodiment 1 of the present invention will be described with reference to FIGS. 2 to 11.

Incidentally, in the following embodiments, as an electrophotographic image forming apparatus, a full-color electrophotographic image forming apparatus to which four process cartridges are detachably mountable is described as an example.

However, the number of the process cartridges to be mounted in the image forming apparatus is not limited to four but may appropriately be set as desired.

For example, in the case of an image forming apparatus for forming a monochromatic image, the number of the process cartridges to be mounted in the image forming apparatus is one. Further, in the following embodiments, as an example of the image forming apparatus, a printer is exemplified.

However, the image forming apparatus is not limited to the printer. The present invention is also applicable to, e.g., other image forming apparatuses such as a copying machine, a facsimile machine and a multi-function machine having functions of these machines in combination.

<General Structure of Image Forming Apparatus>

Figure 2:
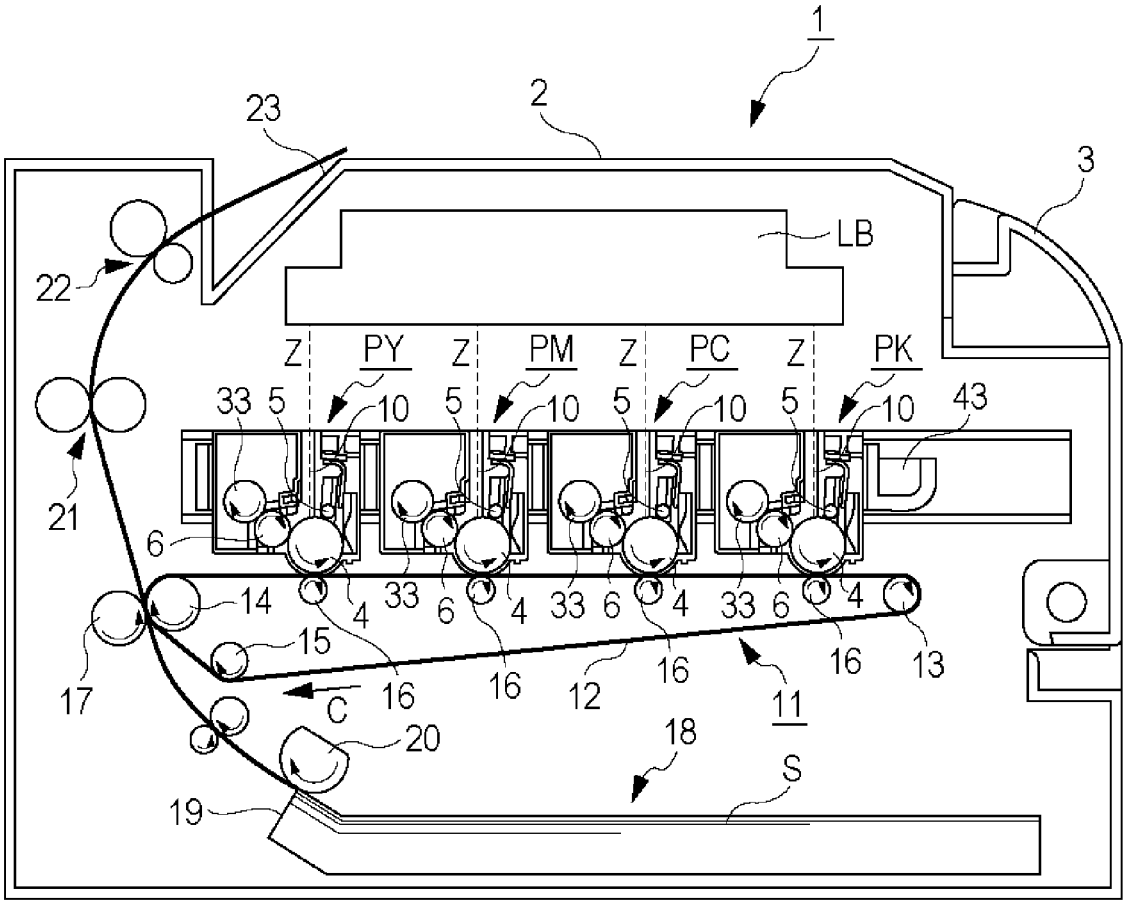
FIG. 2 is a schematic sectional view showing an example of an image forming apparatus main assembly in Embodiment 1.

First, FIG. 2 is a schematic sectional view of the image forming apparatus in this embodiment.

An image forming apparatus 1 is a four color-based full-color laser printer using the electrophotographic image forming process and effects color image formation on a recording material S. The image forming apparatus 1 is of a process cartridge type in which the process cartridge is detachably mountable to an apparatus main assembly 2 and a color image is formed on the recording material S.

Here, with respect to the image forming apparatus 1, the side (surface) on which an apparatus openable door 3 is provided is referred to as a front side (surface), and a side (surface) opposite to the front side (surface) is referred to as a rear side (surface). Further, a right side when the image forming apparatus 1 is viewed from the front surface is referred to as a driving side, and a left side is referred to as a non-driving side.

In the apparatus main assembly 2, four cartridges P consisting of a first cartridge PY, a second cartridge PM, a third cartridge PC and a fourth cartridge PK are provided and arranged in a horizontal direction. The respective first to fourth cartridges (PY to PK) have the same electrophotographic process mechanism but contain developers (toners) different in color from one another. To the first to fourth cartridges P (PY to PK), a rotational driving force is transmitted from a drive output portion (not shown) of the apparatus main assembly 2. Further, to the first to fourth cartridges P (PY to PK), bias voltages (charging bias, developing bias and the like) are supplied from the apparatus main assembly 2 (not shown).

Each of the first to fourth cartridges P (PY to PK) includes a cleaning unit 8 including an electrophotographic photosensitive member (hereinafter referred to as a photosensitive drum) 4, and including a charging means and a cleaning means which are used as process means acting on the photosensitive drum 4.

Further, each of the first to fourth cartridges P (PY to PK) includes a developing device 9 including a developing means for developing an electrostatic latent image on the photosensitive drum 4.

The cleaning unit 8 and the developing device 9 are connected with each other. As the charging means, a charging roller 5 is used. As the cleaning means, a cleaning blade 7 is used. As the developing means, a developer carrying member (hereinafter referred to as a developing roller) 6 is used. A more specific constitution of the cartridges will be described below.

The first cartridge PY accommodates the toner of yellow (Y) in its developing (device) frame 29 and forms the toner image of yellow on the surface of the photosensitive drum 4.

The second cartridge PM accommodates the toner of magenta (M) in its developing frame 29 and forms the image of magenta on the surface of the photosensitive drum 4.

The third cartridge PC accommodates the toner of cyan (C) in its developing frame 29 and forms the toner image of cyan on the surface of the photosensitive drum 4.

The fourth cartridge PK accommodates the toner of black (K) in its developing frame 29 and forms the toner image of black on the surface of the photosensitive drum 4.

Above the first to fourth process cartridges P (PY, PM, PC, PK), a laser scanner unit LB as an exposure means is provided. This laser scanner unit LB outputs laser light Z correspondingly to image information. Then, the laser light Z passes through an exposure window portion 10 of each cartridge P, so that the surface of the photosensitive drum 4 is subjected to scanning exposure to the laser light Z.

Under the first to fourth cartridges P (PY, PM, PC, PK), an intermediary transfer belt unit 11 as a transfer member is provided. This intermediary transfer belt unit 11 includes a driving roller 13, a turn roller 14 and a tension roller 15, and includes a transfer belt 12 extended and stretched by the rollers.

The photosensitive drum 4 of each of the first to fourth process cartridges P (PY to PK) is contacted to an upper surface of the transfer belt 12 at its lower surface. A resultant contact portion is a primary transfer portion. Inside the transfer belt 12, primary transfer rollers 16 are provided opposed to the associated photosensitive drums 4.

Oppositely to the turn roller 14, a secondary transfer roller 17 is provided in contact with the transfer belt 12. A resultant contact portion between the transfer belt 12 and the secondary transfer roller 17 is a secondary transfer portion.

Below the intermediary transfer belt unit 11, a sheet feeding unit 18 is provided. This sheet feeding unit 18 includes a sheet feeding tray 19 in which sheets of the recording material S are stacked, and includes a sheet feeding roller 20 and the like.

In an upper left side of the apparatus main assembly 2 in FIG. 2, a fixing unit 21 and a sheet discharging unit 22 are provided. At an upper surface of the apparatus main assembly 2, a sheet discharge tray 23 is defined.

On the recording material S, the toner image is fixed by the fixing means provided in the fixing unit 21, and then the recording material S is discharged onto the discharge tray 23.

<Image Forming Operation>

Next, an operation for forming a full-color image is as follows. The photosensitive drums 4 of the first to fourth cartridges P (PY to PK) are rotationally driven at a predetermined speed (in an arrow D direction in FIG. 3 and in a counterclockwise direction in FIG. 2). The transfer belt 12 is also rotationally driven in the same direction (arrow C direction in FIG. 2) as the rotational direction of the photosensitive drums 4 (at their contact portions) at a speed corresponding to the speed of the photosensitive drums 4.

The laser scanner unit LB is also driven. In synchronism with the drive of the laser scanner unit LB, the surface of the photosensitive drum 4 of each cartridge is electrically charged uniformly to a predetermined polarity and a predetermined potential by the charging roller 5. The scanner unit LB scans and exposes the surface of each photosensitive drum 4 with the laser light Z depending on an associated color image signal.

As a result, the electrostatic latent image depending on the image signal for the associated color is formed on the surface of each photosensitive drum 4. The thus formed electrostatic latent image is developed by the developing roller 6 which is rotationally driven (in an arrow E direction in FIG. 3 or in the clockwise direction in FIG. 2) at a predetermined speed.

By the electrophotographic image forming process operation as described above, on the photosensitive drum 4 of the first cartridge PY, a yellow toner image corresponding to a yellow component for the full-color image is formed. Then, the toner image is primary-transferred onto the transfer belt 12.

Similarly, on the photosensitive drum 4 of the second cartridge PM, a magenta toner image corresponding to a magenta component for the full-color image is formed. Then, the toner image is primary-transferred superposedly onto the yellow toner image which has already been transferred on the transfer belt 12.

Similarly, on the photosensitive drum 4 of the third cartridge PC, a cyan toner image corresponding to a cyan component for the full-color image is formed. Then, the toner image is primary-transferred superposedly onto the yellow and magenta toner images which have already been transferred on the transfer belt 12.

Similarly, on the photosensitive drum 4 of the fourth cartridge PK, a black toner image corresponding to a black component for the full-color image is formed. Then, the toner image is primary-transferred superposedly onto the yellow, magenta and cyan toner images which have already been transferred on the transfer belt 12.

In this way, unfixed toner images of yellow, magenta, cyan and black for the four color-based full-color image are formed on the transfer belt 12.

On the other hand, at predetermined control timing, sheets of the recording material S are separated and fed one by one. The recording material S is introduced into a secondary transfer portion which is a contact portion between the secondary transfer roller 17 and the transfer belt 12 with predetermined control timing. As a result, in a process in which the recording material S is conveyed to the secondary transfer portion, the four color toner images superposed on the transfer belt 12 are collectively transferred onto the surface of the recording material S.

<Structure of Cartridge>

Figure 4:
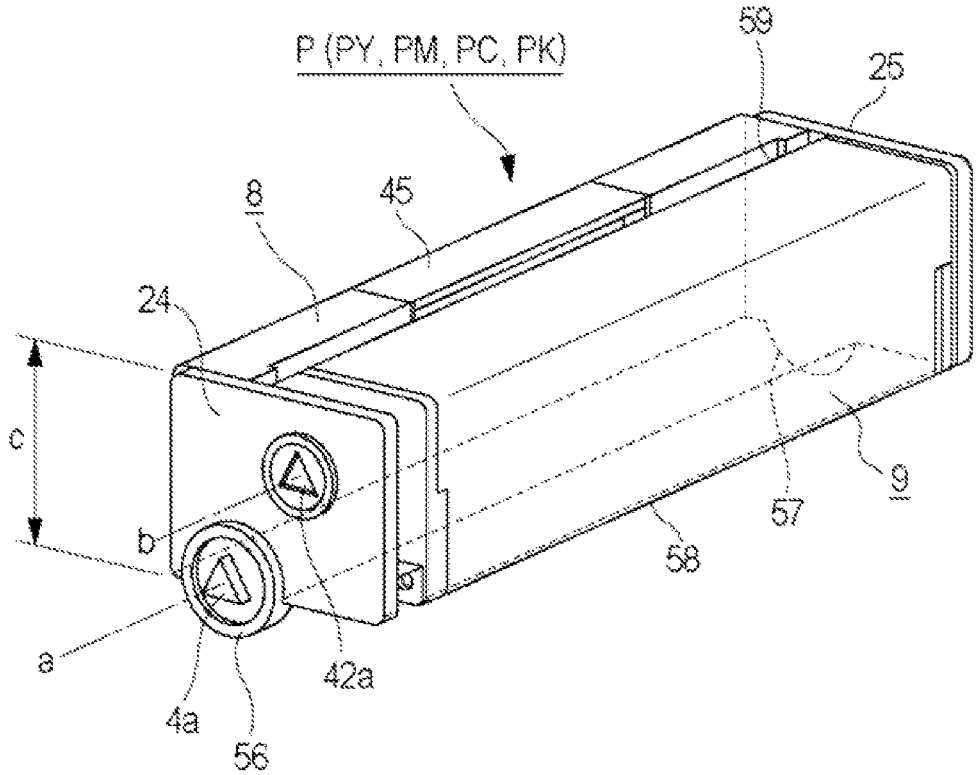
FIG. 4 is a schematic perspective views each showing an example of the cartridge in Embodiment 1.

As shown in FIG. 4, the cartridge P (PY, PM, PC, PK) has a substantially rectangular parallelepiped shape extending in a direction of a rotational axis a of the photosensitive drum 4 as a longitudinal direction, and includes the cleaning unit 8, the developing device 9, a driving-side cover member 24 and a non-driving-side cover member 25.

Figure 3:
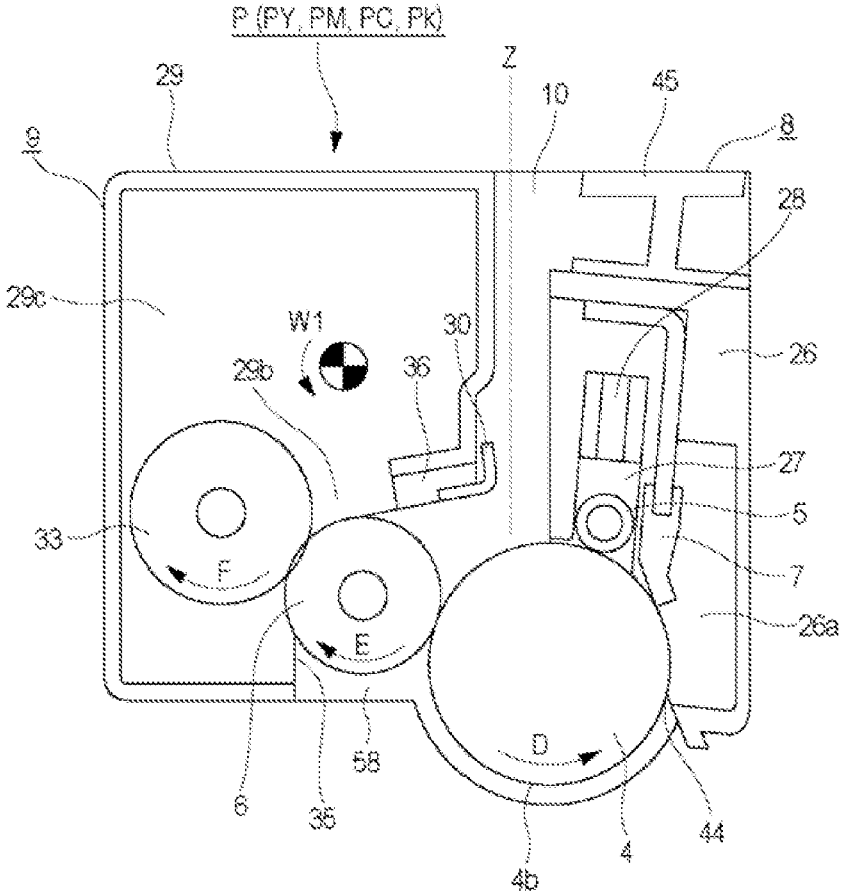
FIG. 3 is a schematic sectional view showing an example of the cartridge in Embodiment 1.

As shown in FIG. 3, the cleaning unit 8 is constituted by the photosensitive drum 4, the charging roller 5, a cleaning container 26 including the cleaning blade 7, and a grip portion 45. The photosensitive drum 4 is rotatably supported by the driving-side cover member 24 and the non-driving-side cover member 25, and obtains a driving force of a motor (not shown) of the apparatus main assembly 2 from drum driving coupling 4*a*, and thus is rotationally driven (in the arrow D direction).

The charging roller 5 is rotatably supported at its end portions by charging roller bearings 27 of the cleaning container 26 and is driven by rotation of the photosensitive drum 4 in contact with the surface of the photosensitive drum 4. At this time, in order to uniformly charge the surface of the photosensitive drum 4, the charging roller 5 is urged against the photosensitive drum 4 by an urging spring 28 at each of the end portions thereof.

The cleaning blade 7 is fixed on the cleaning container 26, and an elastic rubber end portion thereof is disposed in contact with the photosensitive drum 4 in a direction counterdirectionally to the rotational direction (the arrow D direction in FIG. 3). During image formation, the cleaning blade 7 scrapes off a transfer residual toner remaining on the photosensitive drum 4 to clean the surface of the photosensitive drum 4. At this time, the end of the cleaning blade 7 is contacted to the surface of the photosensitive drum 4 at predetermined pressure in order to scrape off the transfer residual toner.

Further, the transfer residual toner scraped off from the surface of the photosensitive drum 4 by the cleaning blade 7 is accommodated as a waste (residual) toner in a residual toner accommodating portion 26*a* of the cleaning container 26. For that purpose, on the cleaning container 26, a residual toner collecting sheet member 44 for preventing the residual toner from leaking out from a gap between itself and the photosensitive drum 4 or the cleaning blade 7 is fixed with respect to the longitudinal direction of the photosensitive drum 4. Further, at each of longitudinal end portions of the cleaning blade 7, a cleaning blade end portion seal member (not shown) is provided.

Further, in this embodiment, the cartridge P is the substantially rectangular parallelopiped. Of six sides, a side 58 includes an exposed portion 4*b* for permitting transfer of the toner image from the photosensitive drum 4 onto the intermediary transfer belt unit 11 described above. A side 59 opposite from the side 58 includes the above-described grip portion 45.

In this embodiment, as the cartridge, the photosensitive drum 4 is integrated with process means, acting on the photosensitive drum 4, including the charging roller 5 as the charging means, the cleaning blade 7 as the cleaning means, and the residual toner accommodating portion 26*a*, but the cartridge is not limited thereto. The photosensitive drum 4 and at least one of the developing means, the charging means and the cleaning means are may also be assembled into a cartridge so as to be detachably mountable to the apparatus main assembly 2.

<Mounting and Demounting Constitution of Cartridge>

Next, a mounting and demounting operation of the cartridge P (PY, PM, PC, PK) with respect to the apparatus main assembly 2 will be described.

Figure 5:
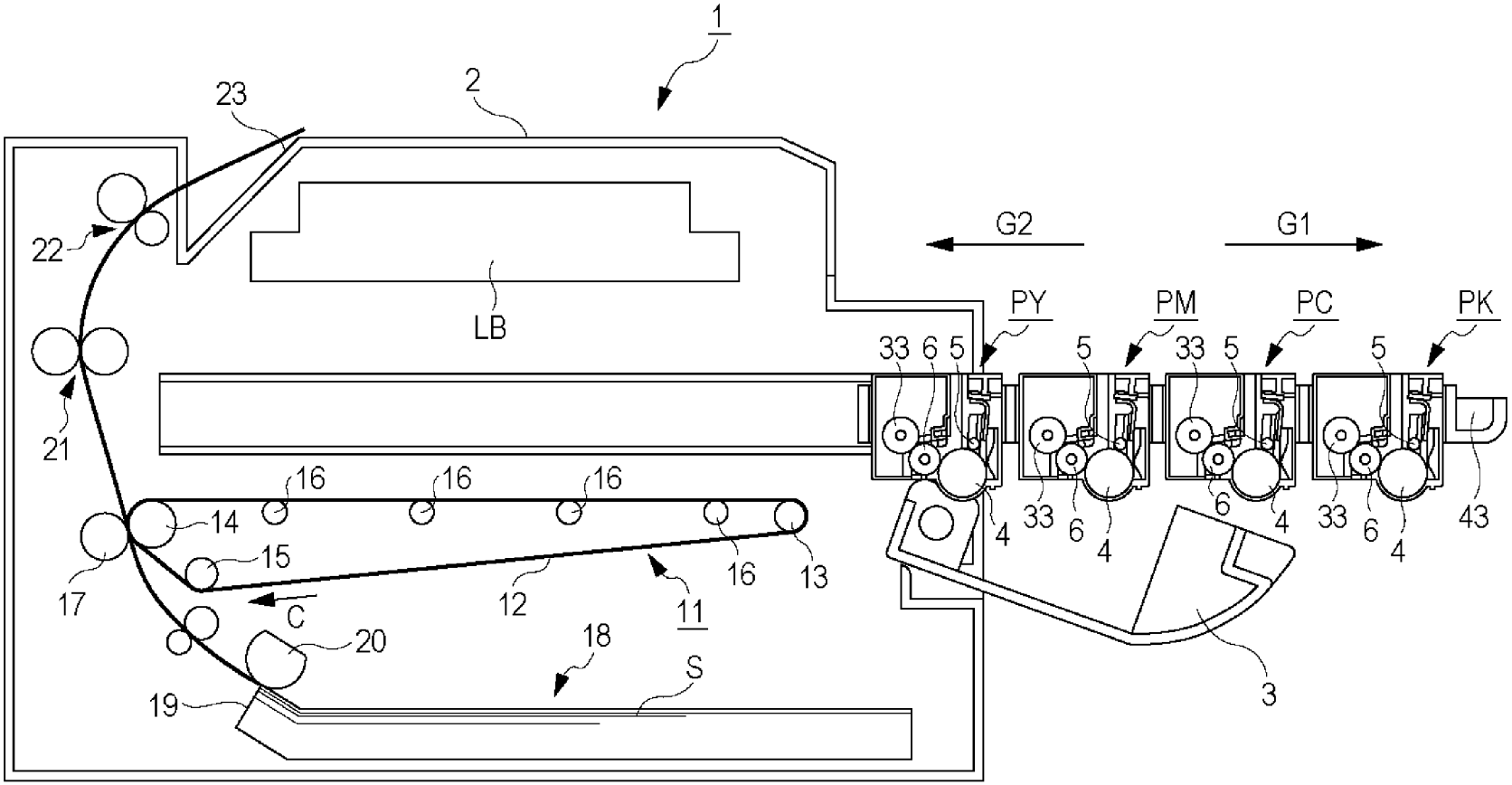
FIG. 5 is a schematic sectional view showing a state of an image forming apparatus in which the cartridge is detachably mountable in Embodiment 1.
Figure 6:
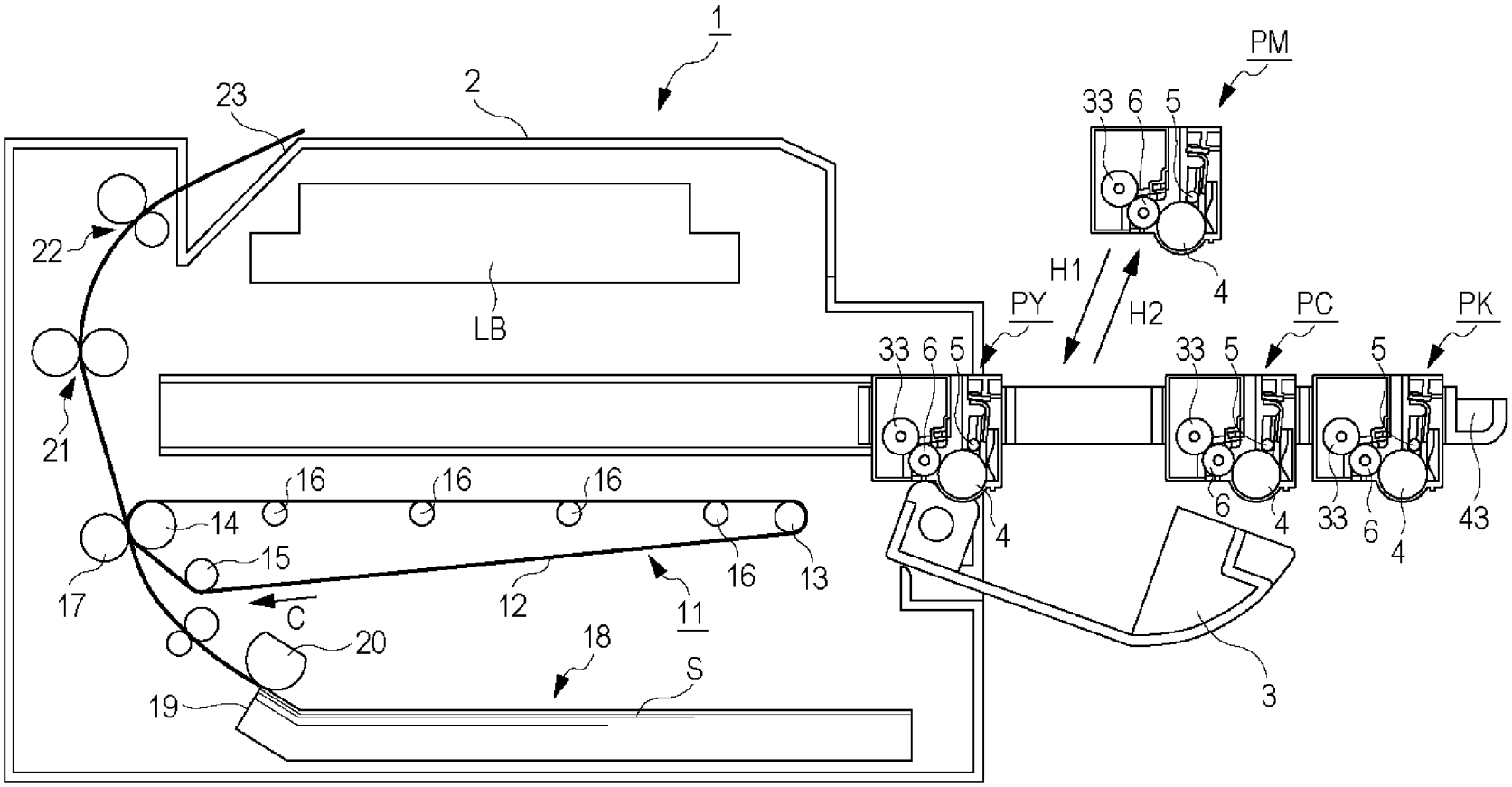
FIG. 6 is a schematic sectional view showing an operation in which the cartridge is demounted from and mounted in a cartridge tray in Embodiment 1.

FIG. 5 is a schematic sectional view showing a state in which a cartridge tray 43 is pulled out from the apparatus main assembly 2 and thus the cartridge P is detachably mountable to the cartridge tray 43. FIG. 6 is a schematic sectional view for illustrating an operation by which the cartridge P is demounted from and mounted into the cartridge tray 43.

Inside the apparatus main assembly 2, the cartridge tray 43 in which the cartridges P are mountable is provided. The cartridge tray 43 is, as shown in FIG. 5, constituted so as to be linearly movable (pushable and pullable) in G1 and G2 directions which are substantially the horizontal direction with respect to the apparatus main assembly 2. Further, the cartridge tray 43 is capable of being in a mounted position, and in a pulled-out position where the cartridge tray 43 is pulled out from the mounted position.

First, the mounting operation for mounting the cartridge P (PY, PM, PC, PK) into the apparatus main assembly 2 will be described.

The apparatus openable door 3 is opened, and then the cartridge tray 43 is moved in G1 direction indicated by an arrow in FIG. 5 to be moved to the pulled-out position. In this state, the cartridge P is mounted in the cartridge tray 43 from an arrow H1 direction to be held. The cartridge tray 43 holding the cartridge P is moved in an arrow G2 direction shown in FIG. 5, so that the cartridge tray 43 is moved to the mounted position. Then, the apparatus openable door 3 is closed, so that the mounting operation of the cartridge P into the apparatus main assembly 2 is completed.

On the other hand, the demounting operation of the cartridge P from the apparatus main assembly 2 will be described. Similarly as in the mounting operation of the cartridge P into the apparatus main assembly 2 described above, the cartridge tray 43 is moved to the pulled-out position. In this state, the cartridge P is demounted in an arrow H2 direction shown in FIG. 6, so that the demounting operation of the cartridge P from the apparatus main assembly 2 is completed. By the above-described operations, the cartridge P is detachably mountable to the apparatus main assembly 2.

<Structure of Developing Device>

Figure 7:
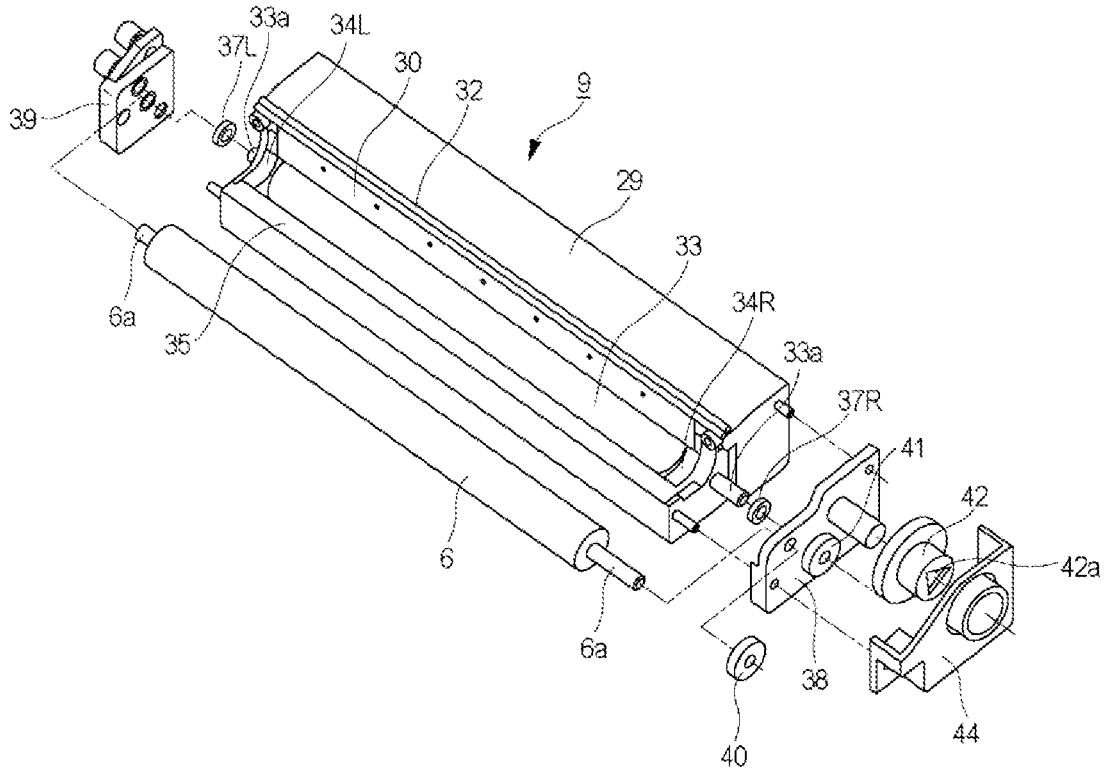
FIG. 7 is a schematic perspective view showing an example of a developing device in Embodiment 1.

As shown in FIGS. 4 and 7, the developing device 9 has an elongated shape in which the developing roller 6 as the developing means extends in a rotational axis direction as the longitudinal direction. In addition to the developing roller 6, the developing device 9 is constituted by the developing frame 29, a developing blade 30 (which is held by structure 36), developing device end portion seal members 34R and 34L, a flexible sheet member 35, and supplying roller shaft seals 37R and 37L.

The developing frame 29 includes a toner accommodating chamber 29*c* for accommodating the toner and includes an opening 29*b* for permitting discharge of the toner from the toner accommodating chamber 29*c*. The developing roller 6 and the developer supplying roller 33 are provided close to the opening 29*b*, and end portions of a shaft of the developing roller 6 are rotatably supported by a driving-side bearing 38 and a non-driving-side bearing 39 which are mounted on side surfaces of the developing frame 29. Further, at driving-side end portions of the core material 6*a* of the developing roller 6 and a core material 33*a* of the developer supplying roller 33 (which is roatationaly driven in an arrow F direction in FIG. 3), a driving gear 40 and a supplying roller gear 41 are provided, respectively, and are engaged with a developing device drive input gear 42. The developing device drive input gear 42 includes a developing device drive coupling 42*a* with which a drive output coupling (not shown) in the apparatus main assembly 2 side, so that a driving force of a driving motor (not shown) for the apparatus main assembly 2 is transmitted and thus the developing roller 6 and the developer supplying roller 33 are rotationally driven at a predetermined speed.

The developing blade 30 is an about 0.1 mm-thick elastic thin metal plate, and a free end of the developing blade 30 with respect to a widthwise direction is contacted to the developing roller 6 counterdirectionally to the rotational direction (arrow E direction in FIG. 3).

As shown in FIG. 7, the developing device end portion seal members 34R and 34L are provided at ends of the opening of the developing frame 29, so that toner leakage from a gap between the developing frame 29 and each of the developing blade 30 and the developing roller 6 is prevented.

Further, the flexible sheet member 35 is provided in contact with the developing roller 6 at a longitudinal side surface in a side where the sheet member 35 opposes the developing blade 30 at the opening of the developing frame 29, thus preventing the toner leakage from a gap between the developing frame 29 and the developing roller 6. Further, the supplying roller shaft seal members 37R and 37L are mounted on the core material 33*a* of the developer supplying roller 33 at exposed portions outside the developing frame 29, thus preventing the toner leakage from a gap between the core material 33*a* and a core material through hole provided in the developing frame 29.

The developing device 9 is always urged by an urging spring (not shown) in a direction (arrow W1 direction in FIG. 3), in which the developing roller 6 is contacted to the photosensitive drum 4, with the swing center (axis b) shown in FIG. 4 as a center.

During the image formation, by the drive, the developer supplying roller 33 and the developing roller 6 are rotated and rubbed with each other, so that the toner in the developer frame 29 is carried on the developing roller 6. The developing blade 30 regulates a thickness of a toner layer formed on a peripheral surface of the developing roller 6, and at the same time, imparts triboelectric charges, generated between itself and the developing roller 6 by contact pressure, to the toner.

Then, at the contact portion between the developing roller 6 and the photosensitive drum 4, the charged toner on the developing roller 6 is deposited on the electrostatic latent image, so that the electrostatic latent image is developed.

<Structure of Packing Material>

A structure of the packing material 46 will be described with reference to FIG. 1 and (a) and (b) of FIG. 8.

Figure 1:
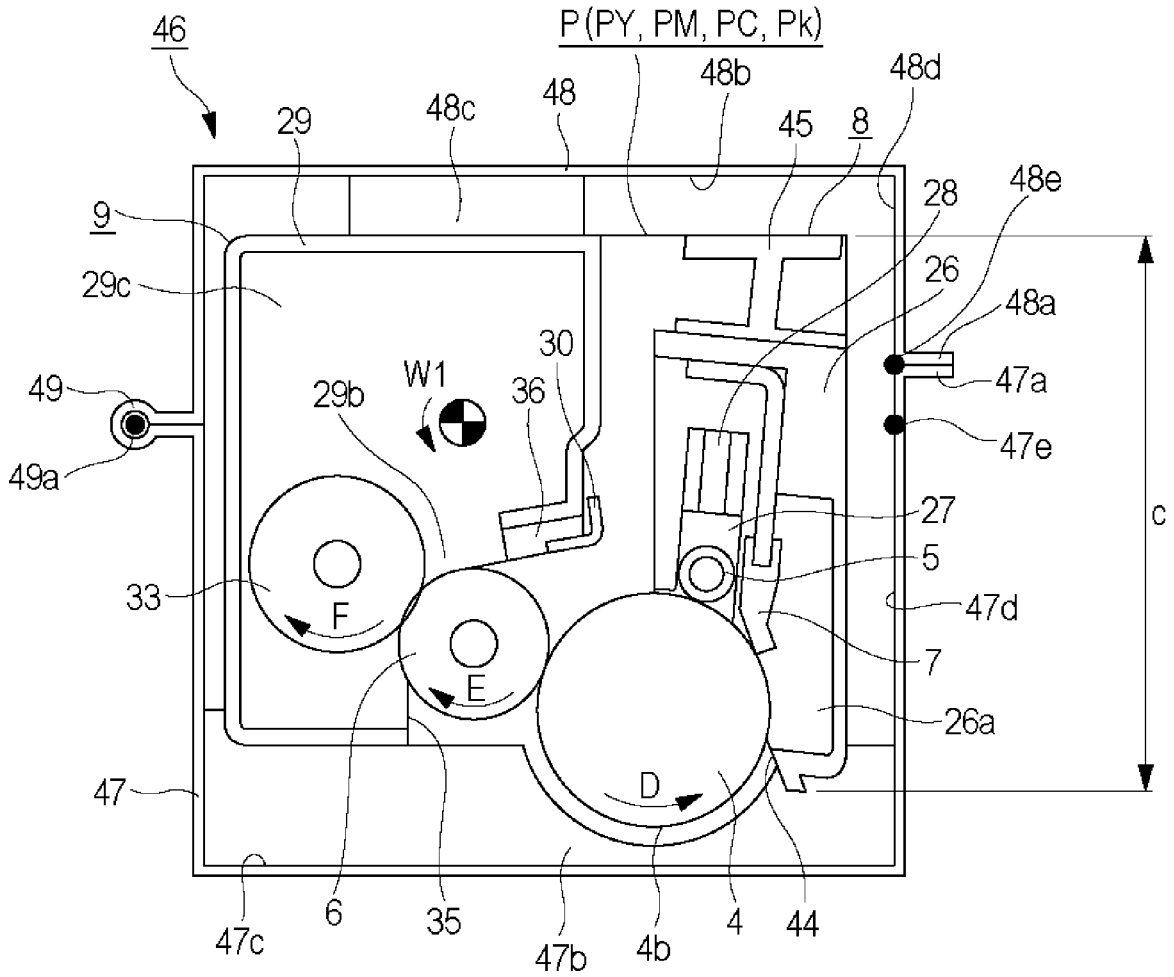
FIG. 1 is a schematic sectional view showing a packing state of a cartridge in a packing material in Embodiment 1.

FIG. 1 is a schematic sectional view showing a packing state of the cartridge P in the packing material 46 in the present invention. Part (a) of FIG. 8 is a schematic perspective view showing the packing material 46 in the present invention. Part (b) of FIG. 8 is a schematic perspective view showing a demountable state of the cartridge P from the packing material 46 in the a direction. FIG. 9 is a schematic perspective view showing a cartridge-packing state of the packing member 46 in the present invention.

The packing member 46 is constituted by a frame portion 47, a cap portion 48 and a hinge portion 49. The hinge portion 49 functions as a rotation-supporting point of the frame 47 and the cap portion 48, and the frame portion 47 and the cap portion 48 are configured to be rotatable relative to each other at the center of the hinge portion 49. Further, cap portion 48 for opening an opening 47*c*1 of the frame 47 is an open position. Each of the frame portion 47, the cap portion 48 and the hinge portion 49 which constitute the packing member 46 is constituted by a thin plate (sheet) of plastic (resin material), such as polyethylene terephthalate or polypropylene, and the portions can be integrally molded by, e.g., vacuum molding. Further, these portions may also be constituted by a paper material such as corrugated card board.

Further, the frame portion 47 has a recessed shape including a first recessed portion 47*c*, and the cap portion 48 has a recessed shape including a second recessed portion 48*b*. Further, at the frame portion 47 and the cap portion 48, flange portions 47*a* and 48*a* are formed so as to surround the first recessed portion 47*c* and the second recessed portion 48*b*, respectively. The frame portion 47 and the cap portion 48 are connected at the hinge portion 49, thus being integrally molded. However, the frame portion 47 and the cap portion 48 are not limited thereto. The first recessed portion 47*c* of the frame portion 47 covers a part of the cartridge P so that the exposed portion 4*b* of the photosensitive drum 4 of the cartridge P which is the substantially rectangular parallelepiped opposes a bottom portion 47*c*2 of the first recessed portion 47*c*. The second recessed portion 48*b* of the cap portion 48 covers a part of the cartridge P so as to oppose the grip portion 45 of the cartridge P which is the substantially rectangular parallelopiped. Further, the flange portion 47*a* of the frame portion 47 and the flange portion 48*a* of the cap portion 48 oppose each other and are connected with each other. That is, the first recessed portion 47*c* and the second recessed portion 48*b* oppose each other to create an accommodating space, so that the cartridge P is accommodated in the accommodating space. Therefore, the whole cartridge P is covered with the frame portion 47 and the cap portion 48, thus being placed in the packed state (FIGS. 1 and 9). A position of the cap portion 48 for closing the opening 47*c*1 of the frame portion 47 shown in FIG. 9 is a closed position. That is, the cap portion 48 is movable between this closed position and the above-described open position (FIG. 8).

Incidentally, in FIG. 1, a connecting position where the flange portion 47*a* of the frame portion 47 and the flange portion 48*a* of the cap portion 48 are connected with each other to accommodate the cartridge P is formed at a position which is roughly ½ of a height c of the cartridge P as seen from the longitudinal direction but is not limited thereto. For example, the flange portions 47*a* and 48*a* may also be formed on a diagonal line or the like of the cartridge P. Further, the cartridge P is the (substantially) rectangular parallelopiped, and the packing member 46 includes the frame portion 47 and the cap portion 48 which are similar figures. However, the cartridge P may have any shape, and if the whole cartridge P or a part, of the cartridge P, to be protected, is covered with the packing material, also the packing material may have any shape.

A bonding method between the flange portion 47*a* of the frame portion 47 and the flange portion 48*a* of the cap portion 48 is (thermal) welding, an adhesive, a double-side tape, hooking, or the like.

At the frame portion 47, a holding portion 47*b* is formed ((a) of FIG. 8). The holding portion 47*b* is formed at each of end portions of the photosensitive drum 4 with respect to an axial direction a in a state in which the cartridge P is accommodated. Further, by supporting a portion-to-be-supported 56 of the driving-side cover member 24 and a portion-to-be-supported 57 of the non-driving-side cover member 25, the cartridge P is held in a specific attitude.

Here, the specific attitude is, in a state in which the cartridge P is demountable from the packing material 46, a state in which the cartridge P is held by the frame portion 47 of the packing material 46 and in which the exposed portion 4*b* of the photosensitive drum 4 of the cartridge P is covered with the packing material 46. That is, the first recessed portion 47*c* accommodates the cartridge P so as not to expose the photosensitive drum 4. Further, the first recessed portion 47*c* prevents the exposed portion 4*b* of the photosensitive drum 4 from contacting the frame portion 47 of the packing material 46 and exposes the grip portion 45 of the cartridge P from the opening 47*c*1 to place the grip portion 45 in an attitude in which the grip portion 45 is capable of being gripped.

At the cap portion 48, a pressure portion 48*c* is formed ((a) of FIG. 8). The pressure portion 48*c* is, in the packing state of the packing material 46, formed in a position where the pressure portion 48*c* contacts the developing frame 29 of the cartridge P (FIG. 1). Further, in the packing state of the packing material 46, the cartridge P is supported by the holding portion 47*b* and the pressure portion 48*c* and is fixed in the packing material 46.

Further, portions other than the holding portion 47*b* and the pressure portion 48*c* do not contact the cartridge P and do not directly transmit the vibration and impact during the transportation to the photosensitive drum 4 and the pressure means, thus functioning as a protecting member for protecting the cartridge P.

Further, the pressure portion 48*c* contacts the developing frame but may also contact portions, except for a region where the latent image is formed on the electrophotographic photosensitive member of the cartridge P, such as the cleaning container 26, the driving-side cover member 24, the non-driving-side cover member and the like. Further, the pressure portion 48*c* is molded at the cap portion 48 but may also be molded at the frame portion 47 and may also be formed as a separate member.

Next, an unpacking operation of the packing material 46 for the cartridge P will be described with reference to FIGS. 1, 10 and 11. FIG. 10 is a schematic sectional view showing a process in which the cartridge P is taken out from the cap portion 48 side of the packing material 46 in the present invention. FIG. 11 is a schematic sectional view showing a process in which the cartridge P is taken out from the frame portion 47 side of the packing material 46.

First, the case where the cap portion 48 is moved relative to the first recessed portion will be described with reference to FIGS. 1 and 10. That is, in this case, the cap portion 48 is moved in a state in which the cartridge P is accommodated in the first recessed portion. The unpacking operation from the cap portion 48 is, in a state in which the cap portion 48 is located in the closed opening, performed by releasing the bonding between the flange portions 47*a* and 48*b* and then by rotationally moving the cap portion 48 in an arrow R direction in FIG. 10 with the hinge portion as a rotation-supporting point 49*a*. That is, the cap portion 48 is rotated from the closed position (FIG. 9) toward the open position (FIG. 8). At this time, the cartridge P is not located on a rotation locus Q of a point 48*e*, closest to the hinge portion 49, of an inner wall surface 48*d* connecting the flange portion 48*a* of the cap portion 48 with the second recessed portion 48*b*, and therefore the cap portion 48 is capable of rotating about the hinge portion 49 relative to the frame portion 47. Therefore, the grip portion 45 of the cartridge P is placed in a state in which the grip portion 45 is exposed from the opening 47*c*1, so that the cartridge P is placed in a state in which the cartridge P is easily demountable from the first recessed portion 47*c*. Then, the grip portion 45 of the cartridge P is gripped to take out the cartridge P from the packing material 46 in an arrow J direction, so that the cartridge P becomes mountable into the apparatus main assembly 2.

Next, the case where the unpacking is made by opening the frame portion 47 relative to the cap portion 48 will be described with reference to FIGS. 1 and 11. That is, in this case, the frame portion 47 is moved in a state in which the cartridge P is supported by the cap portion 48, and with respect to the state of the packing material 46 shown in FIG. 10, the packing material 46 is in a state in which the packing material 46 is turned upside down as shown in FIG. 11. In the case where the packing material 46 is unpacked from the frame portion 47 side, similarly as in the operation from the cap portion 48 side, in the state in which the cap portion 48 is located at the closed position, the bonding between the flange portions 47*a* and 48*b* is released, and then the frame portion 47 is moved in an arrow V direction in FIG. 11 with the hinge portion 49 as the rotation-supporting point 49*a*. Here, the cap portion 48 and the frame portion 47 have the same rotation-supporting point 49*a*.

The cleaning container 26 is located on a rotation locus U of a point 47*e*, closest to the hinge portion 49, of an inner wall surface 47*d* connecting the flange portion 47*a* of the frame portion 47 with the first recessed portion 47*c*. That is, the cartridge P includes an interfering region 65 as an interfering portion (to be subjected to interference). Therefore, as shown in FIG. 11, during the unpacking from the frame portion 47 side, the inner wall surface 47*d* of the frame portion 47 and the cleaning container 26 interfere with each other. As a result, in the case where the user intends to unpack the packing material 46 from the frame portion 47, it is possible to sensuously notify the user that the packing material 46 is not readily unpacked. Therefore, it is possible to cause the user to make a selection so that the unpacking operation for moving the cap portion 48 relative to the first recessed portion 47*c* is performed, thus leading to an improvement in usability.

Further, by not performing the unpacking operation for opening the frame portion 47 relative to the cap portion 48, a fear such that the user inadvertently touches the photosensitive drum 4 to cause image defect is lowered. Further, by employing the above-described constitution, parts, particularly required to be protected, such as the grip portion 45 in the cap portion 48 side in which the packing material 46 is unpackable, the exposed portion 4*b* of the photosensitive drum 4 in the frame portion 47 side in which it is difficult to unpack the packing material 46, and the like part and disposed. As a result, the user can smoothly perform the unpacking of the packing material 46, so that the user can easily mount the cartridge P into the image forming apparatus 1 without a hitch. Further, when the cartridge P is taken out from the frame portion 47 of the packing material 46 after the cap portion 48 is moved, the cartridge P can be demounted from the frame portion 47 without interfering with the frame portion 47 by being vertically taken out from the first recessed portion 47*c* of the frame portion 47.

(Embodiment 2)

As described above, in the case where the packing material 46 is unpacked by moving the frame portion 47, a part of the cartridge P is located on the rotation locus U of the frame portion 47 but the present invention is not limited thereto. A constitution in which the unpacking of the packing material 46 from the frame portion 47 is prevented without relying on the above-described constitution will be described with reference to FIGS. 12 to 16. FIG. 12 is a schematic perspective view showing a state in which a cartridge is demounted from a packing material in this Embodiment. Parts (a) and (b) of FIG. 13 are schematic perspective views each showing an engaging state between the cartridge and the packing material in this Embodiment. FIG. 14 is a schematic perspective view showing a packing state of the cartridge in the packing material in this Embodiment. FIG. 15 is a schematic sectional view for illustrating a process of demounting the cartridge from a cap portion side of the packing material in this Embodiment. FIG. 16 is a schematic sectional view for illustrating a process of demounting the cartridge from a frame portion side of the packing material in this Embodiment. Incidentally, constitutions identical to those in Embodiment 1 will be omitted from description.

As shown in FIG. 12, (a) of FIG. 13, FIG. 14, and FIG. 15, a frame portion 51 of a packing material 50 is provided with an engaging portion 51*d* which is a projection, the cap portion 52 is provided with pressure portions 52*c*, and each of a driving-side cover member (not shown) and a non-driving-side cover member 125 is provided with a portion-to-be-engaged 55.

Further, when a cartridge T is packed in the packing material 50, the engaging portion 51*d* and the portion-to-be-engaged 55 are engaged with each other ((b) of FIG. 13). That is, an interfering region 165 which interferes with the cartridge T when the cartridge T is taken out from the frame portion 51 in the arrow J direction is provided. Incidentally, an engaging state between the driving-side cover member and the engaging portion 51*d* of the frame portion 51 is similar to that with respect to the non-driving-side cover member 125 and therefore will be omitted.

Further, the cartridge T is hold by a holding portion 51*b* and the engaging portion 51*d* of the frame portion 51 and is fixed in the packing material 50, thus being prevented from being spaced from a first recessed portion 51*c*. Further, by bonding a bonding surface 51*a* of the frame portion 51 and a bonding surface 52*a* of a cap portion 52 to each other, a packing state is created. Further, similarly as in Embodiment 1, a second recessed portion 52*b* of the cap portion 52 for opening and closing an opening 51*c*1 of the first recessed portion 51*c* and a grip portion 145 oppose each other, and a bottom portion 51*c*2 of the first recessed portion 51*c* of the frame portion 51 and an exposed portion 114*b* of a photosensitive drum 114 oppose each other (FIG. 14).

The case where the cap portion 52 is moved to unpack the packing material 50 will be described. The unpacking of the packing material 50 from the cap portion 52 is, similarly as in Embodiment 1, performed by releasing bonding between flange portions 51*a* and 52*a* and then by rotationally moving the cap portion 52 about a rotation-supporting point 53*a* of a hinge portion 53 in an arrow R direction in FIG. 15.

At this time, the cartridge T is not located on a rotation locus Q of a point 54, closest to the hinge portion 53, of an inner wall surface 52*d* connecting the flange portion 52*a* of the cap portion 52 with the second recessed portion 52*b*, and therefore the cap portion 52 is rotatable about the hinge portion 53 relative to the frame portion 51. Therefore, similarly as in Embodiment 1, the grip portion 145 is in a state in which the grip portion 145 is capable of being gripped, and then the user grips the grip portion 145 of the cartridge T to take out the cartridge T from the packing material 50, so that the cartridge T is mountable into the apparatus main assembly 2.

Next, the case where the frame portion 51 is moved to unpack the packing material 50 will be described (FIG. 16). An unpacking method from the frame portion 51 side is, similarly as described above, performed by releasing the bonding between the flange portions 51*a* and 52*a* and then by rotationally moving the frame portion 51 in an arrow V direction in FIG. 16 with the hinge portion 53 as the rotation-supporting point 53*a*.

At this time, the cartridge T is held by the engaging portion 51*d* of the frame portion 51, and therefore also the cartridge T is moved together with the frame portion 51 in the arrow V direction. For this reason, the user feels the weight of the cartridge T and thus feels that the packing material 50 is not readily unpacked from the frame portion 51. Therefore, the user moves the cap portion 52 to unpack the packing material 50 and thereafter smoothly grips the grip portion 145. Then, the user grips the grip portion 145 of the cartridge T by one hand and holds the frame portion 51 of the packing material 50 by another hand, and thereafter the user takes out the cartridge T in the arrow J direction while deforming the engaging portion 51*d*. As a result, engagement between the engaging portion 51*d* and the portion-to-be-engaged 55 can be released easily, so that the usability is not impaired.

As described above, in the case where the packing material is unpacked by moving the cap portion relative to the frame portion, there is no interfering region between the cartridge and the cap portion, and in the case where the packing material is unpacked by moving the frame portion relative to the cap portion, the frame portion and the cartridge have an interfering region. Such a packing material is provided in the present invention. Accordingly, when the packing material is unpacked from the frame portion side, it is possible to improve the usability by sensuously notifying the user that the packing material is not readily unpacked.

As described hereinabove, according to the present invention, it is possible to easily take out the cartridge from the packing material for protecting the cartridge from the vibration and impact during the transportation.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 191428/2012 filed Aug. 31, 2012 which is hereby incorporated by reference.

What is claimed is:

1. A packaged cartridge detachably mountable to an image forming apparatus, said packaged cartridge comprising:

(i) a cartridge;

(ii) a frame portion including a recessed portion for accommodating said cartridge; and (iii) a cap portion movable, in a state in which said cartridge is accommodated in said recessed portion, relative to said frame portion so as to cover said cartridge, wherein said frame portion and said cap portion are rotatably connected by a hinge portion, and wherein a gap is provided between said cartridge and a portion of an inner surface of said frame portion such that when said frame portion is moved relative to said cap portion so as to expose said cartridge, said cartridge interferes with said portion of said inner surface of said frame portion.

2. A packaged cartridge according to claim 1, wherein said cap portion includes a second recessed portion, with said recessed portion and said second recess portion forming a space capable of accommodating said cartridge.

3. A packaged cartridge according to claim 1, wherein said cap portion is integrally molded with said frame portion so as to be respectively movable.

4. A packaged cartridge according to claim 1, wherein said recessed portion is capable of accommodating said cartridge so that a photosensitive drum provided in said cartridge is prevented from being exposed.

5. A packaged cartridge according to claim 1, further comprising:

an interference portion for limiting movement of said frame portion by interference with said frame portion when said frame portion is moved relative to said cap portion so as to expose said packaged cartridge with a cap portion side of said packaged cartridge faced down.

6. A packaged cartridge according to claim 1, wherein said gap is provided such that when said cap portion is moved relative to said frame portion in an opening direction, said cartridge does not interfere with said inner surface of said frame portion.

7. A packing material for packing a cartridge detachably mountable to an image forming apparatus, said packing material comprising:

(i) a frame portion including a recessed portion for accommodating the cartridge and an engaging portion for limiting spacing of the cartridge from said recessed portion; and (ii) a cap portion movable, in a state in which the cartridge is accommodated in said recessed portion, relative to said frame portion so as to cover the cartridge, wherein said frame portion and said cap portion are rotatably connected by a hinge portion, and wherein said recessed portion is capable of accommodating the cartridge so that a photosensitive drum provided in the cartridge is prevented from being exposed by engaging said engaging portion with the cartridge.

8. A packing material according to claim 7, wherein said cap portion includes a second recessed portion, with said recessed portion and said second recessed portion forming a space capable of accommodating the cartridge.

9. A packing material according to claim 7, wherein said cap portion is integrally molded with said frame portion so as to be respectively movable.

10. A packing material according to claim 7, wherein said engaging portion is a projection to be engaged with a recessed portion provided in the cartridge.

11. A cartridge detachably mountable to an image forming apparatus and capable of being packed by a packing material, the packing material comprising (i) a frame portion including a recessed portion for accommodating said cartridge so that a grip portion provided on said cartridge is be capable of being gripped, and an engaging portion for limiting spacing of said cartridge from the recessed portion, and (ii) a cap portion movable, in a state in which said cartridge is accommodated in the recessed portion, relative to the frame portion, wherein said cartridge comprises:

a grip portion for gripping said cartridge so as to be capable of being gripped when the cap portion is located in an open position; and a portion-to-be-engaged to be engaged with the engaging portion to limit the spacing of said cartridge from the recessed portion when said cartridge is accommodated in the recessed portion, wherein the frame portion and the cap portion are rotatably connected by a hinge portion, and wherein the recessed portion is capable of accommodating said cartridge so that a photosensitive drum provided in said cartridge is prevented from being exposed by engaging the engaging portion with said cartridge.

* * * * *